US006572394B1

(12) United States Patent
Yamaoka et al.

(10) Patent No.: US 6,572,394 B1
(45) Date of Patent: Jun. 3, 2003

(54) CONNECTOR AND USE THEREOF

(75) Inventors: Atsushi Yamaoka, Yokkaichi (JP); Yukinori Saka, Yokkaichi (JP); Koji Okutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/235,141

(22) Filed: Sep. 4, 2002

(30) Foreign Application Priority Data

May 28, 2002 (JP) ..... 2002-154476

(51) Int. Cl.[7] ..... H01R 29/00
(52) U.S. Cl. ..... 439/188
(58) Field of Search ..... 439/188, 352, 439/489, 490, 350, 357, 358, 509, 595, 752; 200/51.1

(56) References Cited

U.S. PATENT DOCUMENTS 5,346,405 A * 9/1994 Mosser, III et al. ..... 439/188
5,370,543 A * 12/1994 Hamada ..... 439/188
6,036,515 A * 3/2000 Nakamura ..... 439/188
6,241,542 B1 6/2001 Nishide et al.

* cited by examiner

*Primary Examiner*—Jean F. Duverne
(74) *Attorney, Agent, or Firm*—Gerald E. Hespos; Anthony J. Casella

(57) ABSTRACT

A connector has male and female housings (10, 20). A resilient member (50) is mounted in the female housing (20) for movement along the connecting direction of the housings (10, 20), and is biased forwardly toward the male housing (10) by springs (70) in the female housing (20). A front end (10*a*) of the male housing (10) pushes the resilient member (50) rearwardly during a connecting operation and resiliently compresses the springs (70). A lock arm (28) on the male housing (10) locks the housings (10, 20) together in properly connected state. However, the springs (70) expand resiliently to separate the housings (10, 20) if the correcting operation is interrupted prematurely. The female housing (20) has a cover (40) that can be moved rearwardly to deflect the lock arm (28) and to separate the housings (10, 20).

12 Claims, 15 Drawing Sheets

CONNECTOR AND USE THEREOF

BACKGROUND OF THE INVENTION

1. Field of the Invention

The invention relates to a connector that prevents partial connection.

2. Description of the Related Art

A known connector for an air bag circuit of an automotive vehicle is disclosed in U.S. Pat. No. 6,241,542 and is shown in FIGS. 14 and 15 herein. This connector has male and female housings 1, 2 that can be connected with each other. The male housing 1 has a lock arm 3 that is deformed during connection. However, the lock arm 3 is restored resiliently to engage a lock 4 of the female housing 2 when the housings 1, 2 are connected properly. A slider 5 is mounted in the male housing 1 and a spring 6 is mounted in the slider 5. The deformed lock arm 3 engages the slider 5 and prevents rearward movement of the slider 5 in the male housing 1. The female housing 2 has a rib 7 that compresses the spring 6 during connection of the housings 1, 2, and the biasing force accumulated in the compressed spring 6 is released to separate the housings 1, 2 if the connecting operation is interrupted prematurely.

The lock arm 3 is restored resiliently when the housings 1, 2 are connected properly, and the restored lock arm 3 disengages from the slider 5. As a result, the biasing force of the spring 6 is released and moves the slider 5 backward. The slider 5 has a preventing portion 8 that moves into a deformation permitting space adjacent the restored lock arm 3 to prevent a deformation of the lock arm 3 away from the lock 4.

The housings 1, 2 can be separated by moving the slider 5 forward sufficiently for the preventing portion 8 to retract from the deformation permitting space. The male housing 1 then is pulled rearwardly. The pulling forces deform the lock arm 3 and disengage the lock arm 3 from the lock 4 to permit complete separation of the housings 1, 2.

The procedure for separating the housings 1, 2 requires the slider 5 to be pushed forward and held against the biasing force of the spring 6 while the male housing 1 is pulled backward. Accordingly, operability is poor because the male housing 1 and the slider 5 are moved in opposite directions.

The present invention was developed in view of the above problem and an object thereof is to improve efficiency in separating connectors.

SUMMARY OF THE INVENTION

The invention is directed to a connector with first and second housings that are connectable with each other and a locking means for locking the housings in a properly connected state. The second housing has a resilient member that is movable substantially along a connecting direction of the housings, and the first housing has a pusher that pushes the resilient member back in the inserting direction as the housings are being connected. The resilient member also is resiliently displaceable at an angle to the connecting direction. A guide directs the resilient member away from the pusher when or shortly before the housings are connected properly. A resiliently deformable biasing member is provided between the resilient member and the second housing. The biasing member accumulates a biasing force to separate the housings as the resilient member is moved backward.

The connector may comprise an operable member that is movable substantially along the connecting direction. The operable member is assembled with the second housing to stop at a front-limit position thereof. The operable member also can stop the resilient member at a front-limit position.

The pusher pushes the resilient member as the housings are being connected, and hence the biasing member is compressed between the resilient member and the second housing. The operable member can stop at its front-limit position with respect to the second housing, and thus the connecting operation can be performed by operating the operable member.

The biasing force accumulated in the biasing member is released to separate the housings if the connecting operation is interrupted prematurely. Thus, the housings are prevented from being left only partly connected.

The housings are locked together after proper connection, and the resilient member is displaced by the guide and released from the pusher. Thus, the biasing force accumulated in the biasing member is released to move the resilient member forward.

The operable member is moved rearward to separate the properly connected housings. This rearward movement of the operable member also compresses the biasing member. If locking by the locking means is canceled in this state, the biasing force of the biasing means is released to move the first housing back with respect to the second housing.

The operating direction of the operable member is the same as a separating direction of the second housing. Thus, operational efficiency during the separation is good. Further, the housings can be connected and separated by operating the operable member. Therefore, operational efficiency is better than a connector in which one housing is operated during connection and the operable member is operated during separation.

The locking means preferably comprises a lock in one of the housings, and a lock arm at the other of the housings. The lock arm is resiliently engageable with the lock when the housings are connected properly.

At least one of the lock arm and the operable member may comprise unlocking means for displacing the lock arm away from the lock as the operable member is moved back to separate the housings from each other.

The lock arm is displaced by the unlocking means and automatically is disengaged from the lock when the operable member is moved back to separate the housings. Thus, operational efficiency is improved as compared to a connector that necessitates a separate operation of displacing the lock arm to separate the housings.

The unlocking means preferably comprises an unlock pressing portion for pressing the lock arm out of engagement from the lock.

The unlocking means may unlock the housings at a position of the operable member more backward than the front-stop position.

The resilient member preferably is metallic and/or the pusher is formed by the front end surface of the second housing.

The construction of the first housing can be simplified since the front end surface of the first housing is the pusher. The resilient member remains resiliently displaced with the housings properly connected if the resilient member is pushed by the front end surface of the first housing. However, since the resilient member is metallic, resiliency will not deteriorate as compared to a case where the resilient member is made of a resin.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
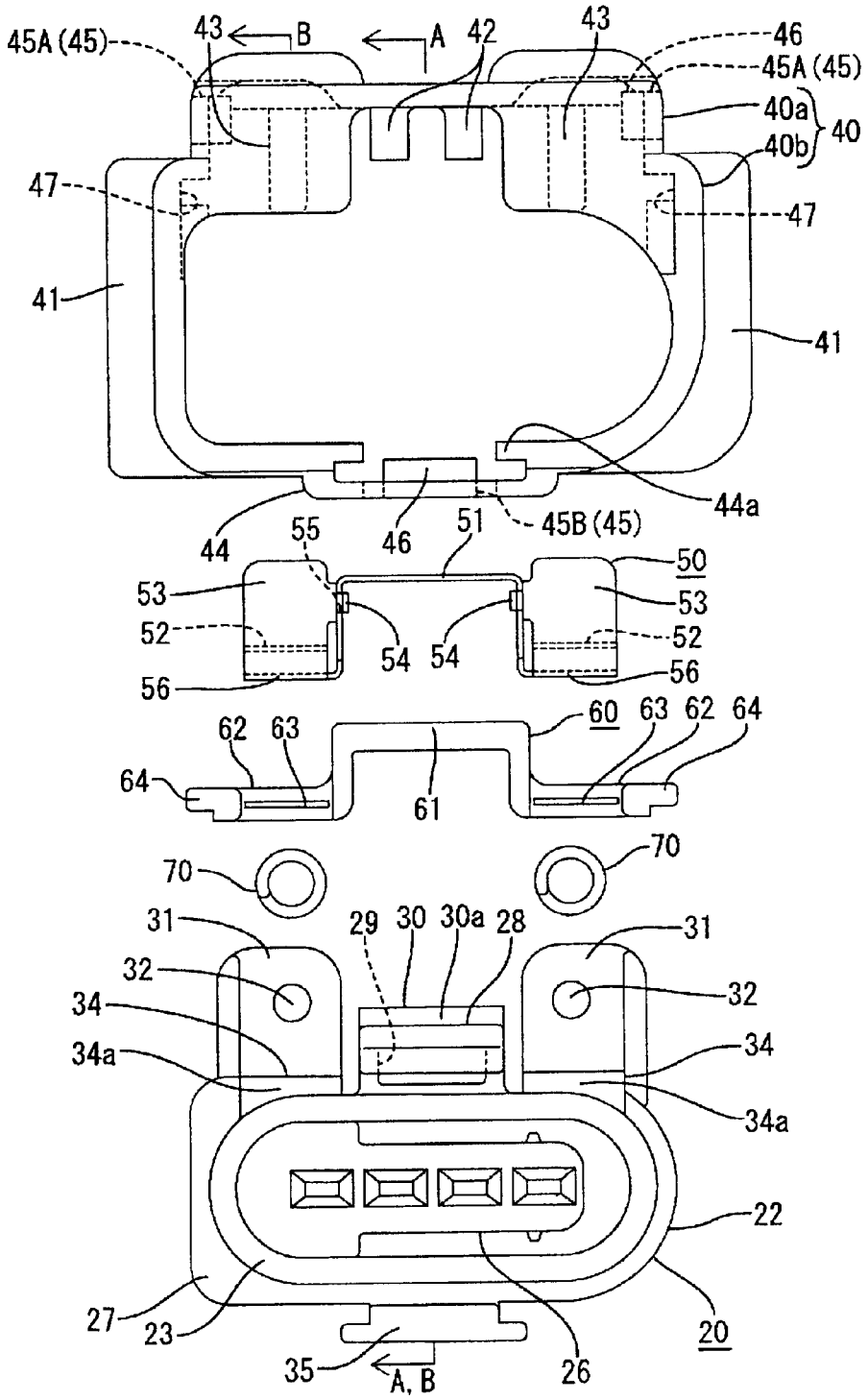
FIG. 1 is an exploded front view of a female housing, compression coil springs, a slide and a resilient member according to the invention.
Figure 2:
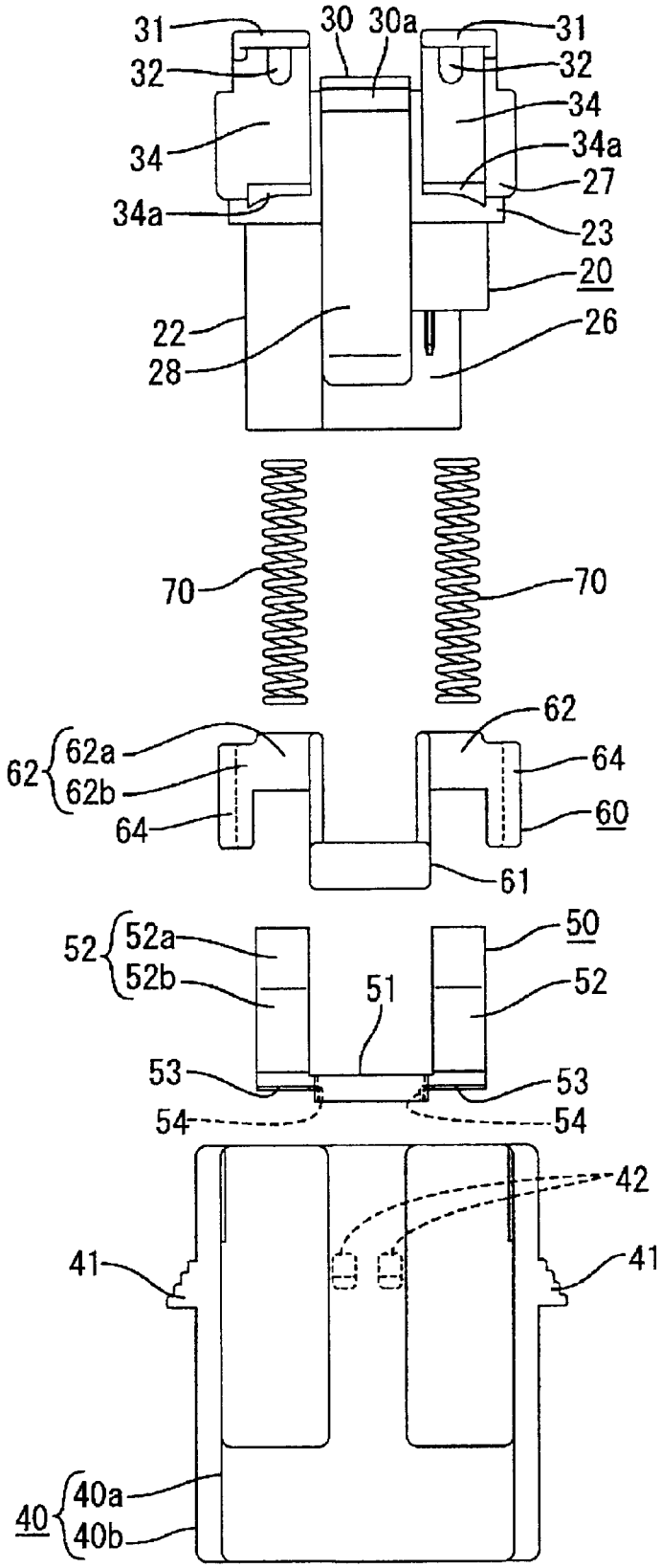
FIG. 2 is an exploded plan view showing the female housing, the compression coil springs, the slidable member and the resilient member.

A connector according to the invention is illustrated in FIGS. 1 to 13, and is intended for use in an air bag circuit of an automotive vehicle. This connector has a male housing 10 that preferably is connected with a piece of equipment and a female housing 20 at an end of an unillustrated wire. The male and female housings 10, 20 are connectable with each other along a connecting direction CD. In the following description, sides of the housings 10, 20 that are to be connected are referred to as the front, and reference is made to FIGS. 1 and 8 concerning the vertical direction.

Figure 8A:
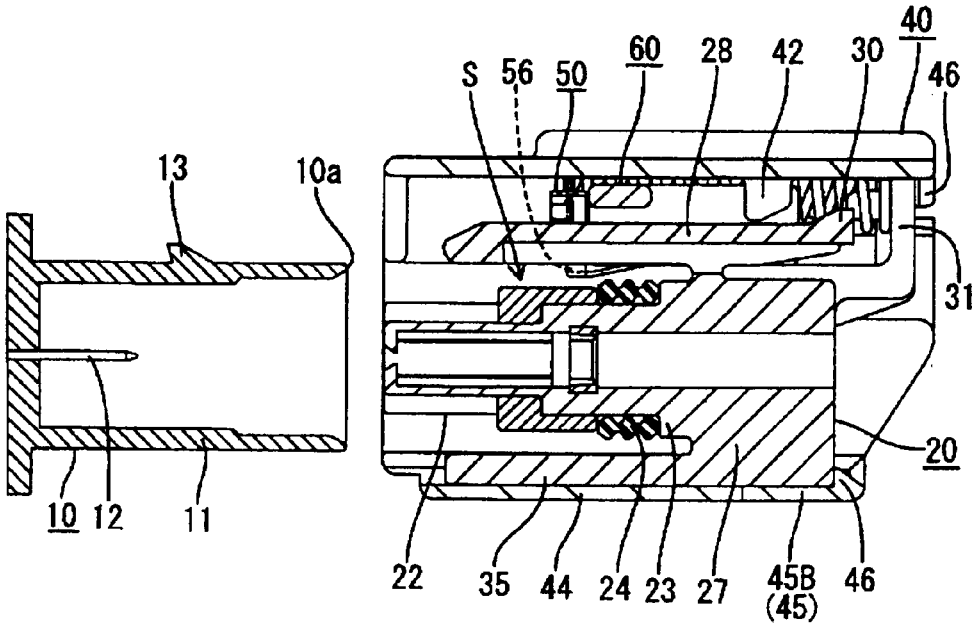
FIGS. 8(A) and 8(B) are sections taken respectively along 8A–8A, 8B—8B of FIG. 6 showing a state before two housings are connected.
Figure 8B:
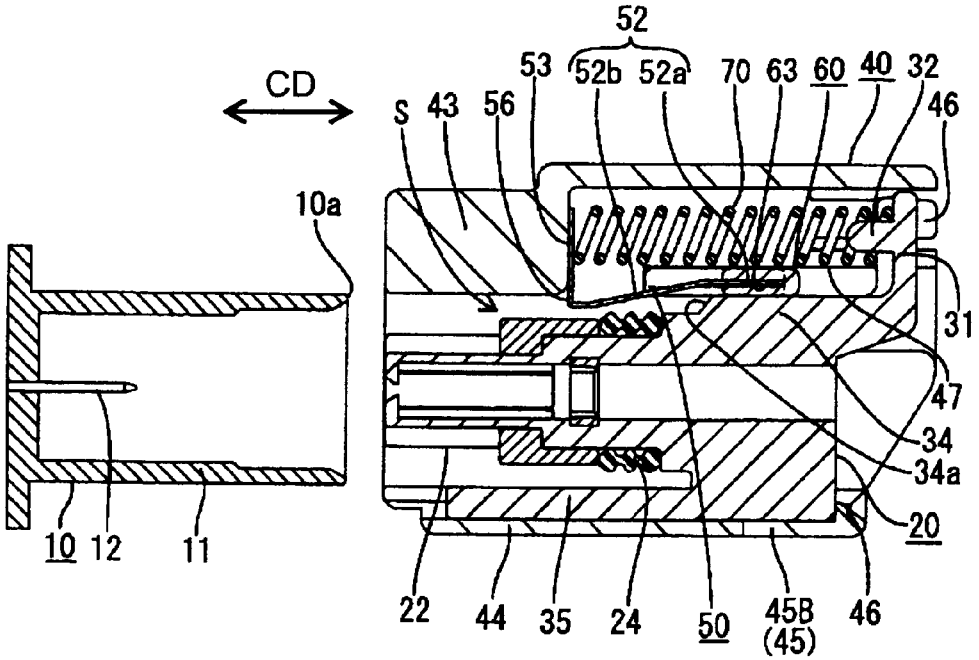

The male housing 10 is made of a synthetic resin, and includes a wide tubular receptacle 11 that projects forward, as shown in FIG. 8. The receptacle 11 surrounds four tab-shaped male terminal fittings 12 that project substantially side by side along the widthwise direction from the back end surface of the male housing 10. A lock 13 projects up from the upper surface of the receptacle 11. The front surface of the lock 13 is inclined up and back, and the rear surface of the lock arm 28 is inclined down and slightly to the front.

The female housing 20 is made of a synthetic resin and includes a terminal-accommodating portion 22 with four cavities 21 arranged side-by-side along the width direction, as shown in FIGS. 1 to 5. Female terminal fittings (not shown) connected with wires can be inserted into the cavities 21 from behind. A cover 40 is mounted on the female housing 20 to define a substantially annular connection space S between the terminal-accommodating portion 22 and the cover 40 (see FIG. 6), and the receptacle 11 of the male housing 10 can be fit into the connection space S from the front.

Figure 4:
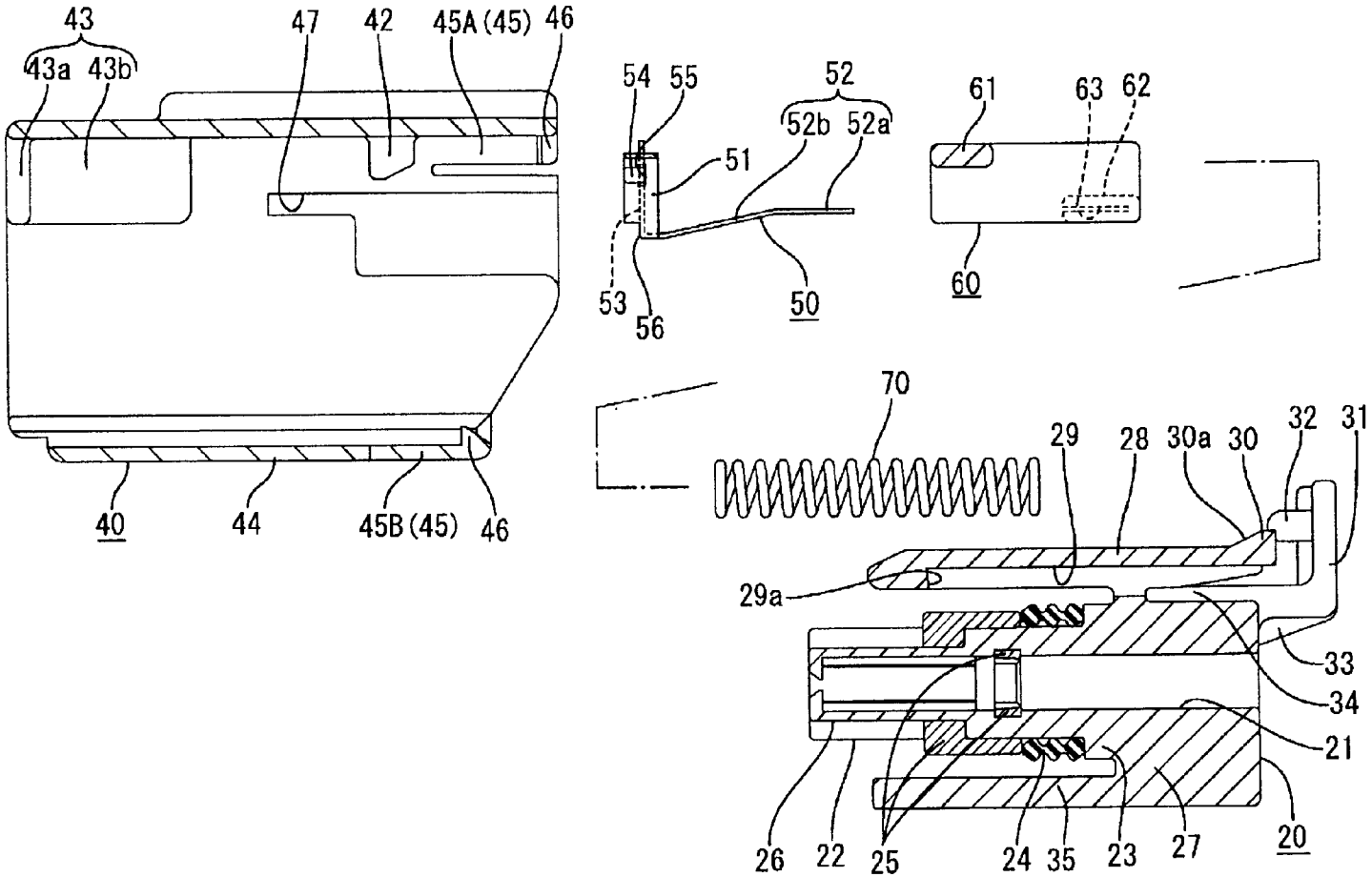
FIG. 4 is a section along 4—4 of FIG. 1.

A rear part of the terminal-accommodating portion 22 is widened radially at two positions to define a front step 23 and a rear step 27. The receptacle, 11 is fittable on the front step 23. A seal ring 24 is mounted immediately before the front step 23 and is squeezed between the inner surface of the receptacle 11 and the outer surface of the front part of the terminal-accommodating portion 22 for sealing a space between the housings 10, 20. A retainer 25 is mountable immediately before the seal ring 24 from the front and can enter the cavities 21. Thus, the seal ring 24 is between the retainer 25 and the first step 23 along the longitudinal direction, as shown in FIG. 4. The retainer 25 is movable laterally with respect to the terminal-accommodating portion 22 between partial and full locking positions. The retainer 25 at the partial locking position is retracted from the cavities 21 and permits insertion and withdrawal of the female terminal fittings. The retainer 25 at the full locking position enters the cavities 21 and locks the female terminal fittings in the cavities 21. A portion of the terminal-accommodating portion 22 where the retainer 25 is mounted is cut away to form an escaping portion 26.

A top center portion of the rear step 27 of the terminal-accommodating portion 22 is cut away, and a lock arm 28 projects on the upper surface of the cut-away portion. The lock arm 28 has a support point at a longitudinal center position and has front and rear arms that extend forward and backward for resilient vertical pivoting movement of the lock arm 28 about the support point. Thus, the lock arm 28 resembles a seesaw. A backwardly open groove 29 is formed in the bottom surface of the lock arm 28, and a front end surface 29*a* of this groove 29 is engageable with the lock 13. The front end surface 29*a* is inclined slightly backward to hold the housings 10, 20 connected with a larger force. An unlock guide 30 projects up over the entire width at the rear end of the upper surface of the lock arm 28. The front surface of the unlock guide 30 is formed into a slanted surface 30*a* inclined up and to the back.

Spring-receiving portions 31 are provided on opposite sides of the lock arm 28 for supporting rear ends of compression coil springs 70 mounted in the female housing 20. Each spring-receiving portion 31 defines an L-shape when viewed from the side, and includes a horizontal leg that extends back from the rear end of the terminal accommodating portion 22 and a vertical leg that extends up from the rear end of the horizontal leg. An engaging projection 32 projects forward from the vertical leg of each spring-receiving portion 31 and is fittable into the rear end of the spring 70. A reinforcing rib 33 extends between the bottom surface of the horizontal leg and the rear end of the terminal accommodating portion 22, and a rib shorter than the engaging projection 32 projects forward from the outer edge of each vertical leg.

The rear step 27 of the terminal accommodating portion 22 is transversely asymmetrical when viewed from the front. However, upper widthwise areas of the rear step 27 corresponding to the two spring-receiving portions 31 define release guides 34 that are transversely symmetrically and have heights substantially the same as the bottom surface of the lock arm 28. The two release guides 34 have flat upper surfaces and slanted front surfaces 34*a* that incline up and to the back. A guide rail 35 projects at substantially the widthwise center of the bottom surface of the rear step 27 and has an inverted T-shape when viewed from the front. The guide rail 35 extends forward and back and has substantially the same length as the lock arm 28.

A wide frame-shaped synthetic resin cover 40 substantially surrounds the female housing 20. The cover 40 is longer than the female housing 20 and covers the entire length of the female housing 20.

Two operable portions 41 project sideways from opposite side surfaces of the cover 40. The operable portions 41 have a height of more than half, and preferably about ¾, of the height of the cover 40 and are stepped to project more sideways at more forward positions. A narrowed portion 40*a* of the cover 40 projects up beyond the operable portions 41.

Two laterally spaced unlock pressing portions 42 project down from the inner surface of the narrowed portion 40*a*. The bottom ends of the unlock pressing portions 42 are slightly higher than the upper end of the lock arm 28, but are lower than the upper ends of the unlock guides 30 when the female housing 20 is mounted in the cover 40 (see FIG. 6). A slanted surface 42*a* at the bottom rear of each unlock pressing portion 42 inclines up and back parallel to the slanted surface 30*a* of the corresponding unlock guide 30.

Two front-stops 43 are provided at the outer sides of the unlock pressing portions 42. Each front-stop 43 extends from the narrowed portion 40*a* to a widened portion 40*b* of the cover 40 and has a flat vertical front wall 43*a* and a T-shaped rib 43*b* that extends back from the front wall 43*a*. The ribs 43*b* have a length less than half, and preferably about ⅓, of the entire length of the cover 40.

A guide channel 44 bulges down from the widthwise center of the bottom of the widened portion 40*b* for receiving the guide rail 35 of the female housing 20. Opposed support flanges 44*a* extend toward one another at upper inner edges of the guide channel 44 for supporting jaws of the guide rail 35. Thus, the cover 40 and the female housing 20 can be guided for relative forward and backward displacement along a fitting direction by holding the guide rail 35 substantially in sliding contact with the guide channel 44.

The cover 40 has two upper holding arms 45A and a lower holding arm 45B for holding the female housing 20 at its front-limit position. Each holding arm 45A, 45B is a resiliently deformable cantilever that projects rearwardly and a claw 46 projects from the free inner rear end. The rear surface of each claw 46 is slanted up and to the front, whereas the front surface thereof is aligned substantially normal to the forward and backward directions. The holding arms 45A, 45B are easily resiliently deformable by bringing the female housing 20 into sliding contact with the rear surfaces of the claws 46. The front surfaces of the claws 46 then engage the rear end of the female housing 20 to support the cover 40 at the front limit position or initial mount position on the female housing 20, as shown in FIG. 8. In the above held state, the cover 40 covers the entire length and the entire outer periphery of the female housing 20.

Figure 3:
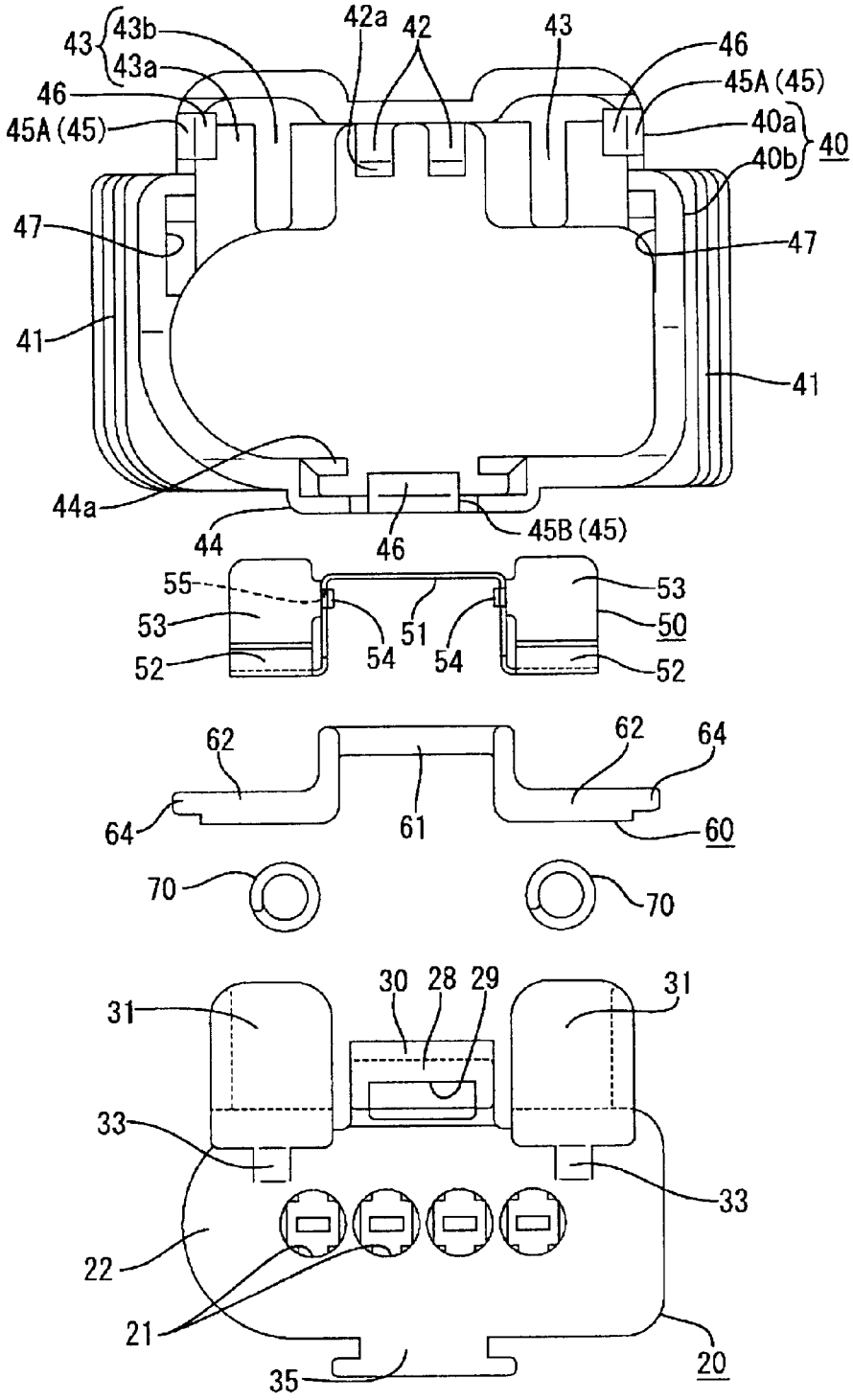
FIG. 3 is an exploded rear view showing the female housing, the compression coil springs, the slidable member and the resilient member.

The two upper holding arms 45A are on the narrowed portion 40*a* at the top of the cover 40, and the lower holding arm 45B is on the bottom of the widened portion 40*b*. Each upper holding arm 45A is formed by upper and lower slits at the opposite vertical sides of the narrowed portion 40*a*. The upper holding arms 45A are resiliently deformable along the widthwise direction, and the respective claws 46 thereof engage the rear end surfaces of the spring-receiving portions 31 of the female housing 20. The lower holding arm 45B is formed by left and right slits at the widthwise center of the guide channel 44, as shown in FIG. 3. The lower holding arm 45B is about twice as wide as the height of the upper holding arms 45A. The lower holding arm 45B is vertically resiliently deformable, and the claw 46 thereof is engageable with the rear end surface of the guide rail 35 of the female housing 20.

The female housing 20 also has a resilient member 50 formed by bending a metallic plate that has been stamped or cut into a specified shape. The resilient member 50 has a bridge 51 and two arms 52 that extend back from the bridge 51 to define a substantially gate-shape when viewed from the front (FIG. 3). Each arm 52 is vertically resiliently deformable and is bent at an intermediate position so that a rear portion 52*a* extends substantially horizontally while a front portion 52*a* extends obliquely down to the front. The bridge 51 joins inner edges of the front ends of the arms 52, and projects slightly forward from the arms 52. Spring-pressing portions 53 stand up from the front ends of the arms 52 to support the front ends of the springs 70. Holding pieces 54 project in from the inner edges of the spring-pressing portions 53. The spring-pressing portions 53 can be held substantially straight and vertical by inserting the holding pieces 54 into holding holes 55 formed in the opposite sides of the bridge 51 and bending them forward.

The female housing 10 also has a synthetic resin slide 60. The slide 60 has a bridge 61 that joins two holders 62 to define a gate-shape when viewed from the front. The bridge 61 has opposite sides that extend back from a wide upper portion, and the holders 62 project from the bottom extending ends of the sides. Each holder 62 has a leg 62*a* that projects transversely from the bridge 61 and a leg 62*b* that projects forward so that each holder 62 defines an L-shape. A holding groove 63 is formed in the front surface of the transverse leg 62*a* of each holder 62, and the rear portion 52*a* of the corresponding arm 52 of the resilient member 50 is press fit into the holding groove 63. Thus, the front portions 52*a* of the arms 52, the spring-pressing portions 53 and the bridge 51 are vertically resiliently displaceable about the rear portions 52*a* (see FIG. 11(B)). The projecting legs 62*b* of the holders 62 are spaced from the sides of the bridge 61 by a distance that exceeds the width of the arms 52, so that the arms 52 can be guided into the corresponding holding grooves 63.

Outer ends of the projecting legs 62*b* of the holders 62 have recessed lower surfaces to define guides 64 for insertion into guide grooves 47 in the cover 40. The guide grooves 47 are formed in the inner surface of the vertical sides of the widened portion 40*b* and open backward. Movement of the slide 60 is guided by sliding the guides 64 in the guide grooves 47. Upper inner surfaces of the guide grooves 47 are straight in forward and backward directions. However, lower inner surfaces of the guide grooves 47 are stepped at an intermediate position to be located lower near the open back. This prevents the bridges 51, 61 of the resilient member 50 and the slide 60 from interfering with the unlock pressing portions 42 and enables easy insertion of the guides 64 when the slide 60 and the resilient member 50 are mounted.

Figure 6:
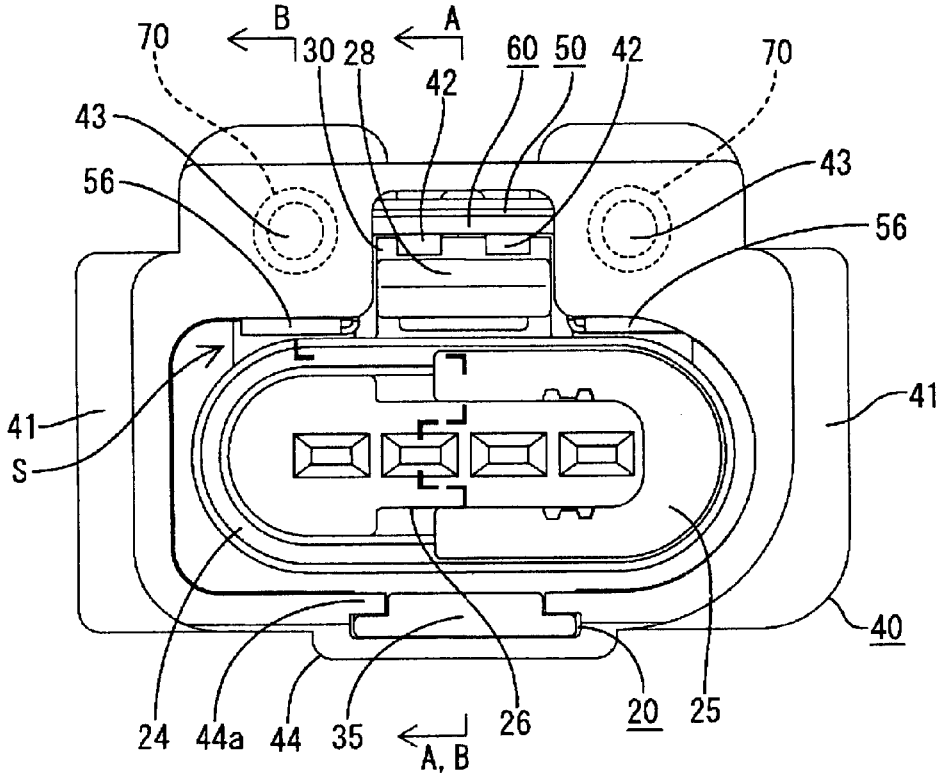
FIG. 6 is a front view of the female housing assembled with the cover.
Figure 7:
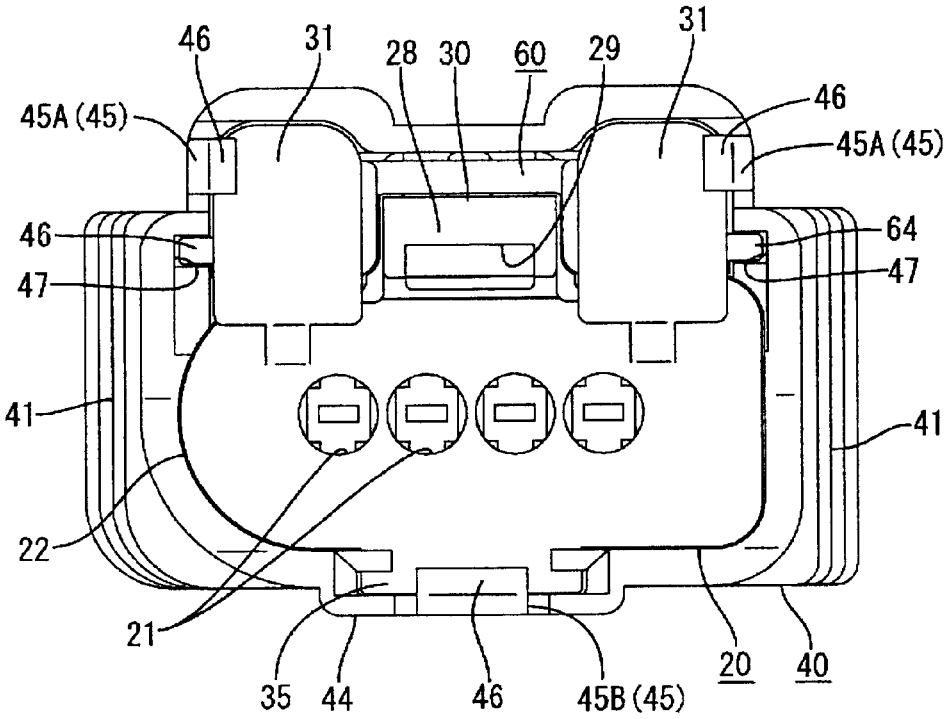
FIG. 7 is a rear view of the female housing assembled with the cover.

The female housing 20, the cover 40, the springs 70, the slide 60 and the resilient member 50 can be assembled, as shown in FIGS. 6 to 8. In this assembled state, the cover 40 is held at the initial mount position on the female housing 20 by the respective holding arms 45A, 45B, and will not move further forward. The springs 70 are supported in a slightly compressed state between the spring-receiving portions 31 of the female housing 20 and the spring-pressing portions 53 of the resilient member 50, which, in turn is held in contact with the front-stops 43 of the cover 40. Thus, the springs 70 urge the cover 40 forwardly and into the initial mount position on the female housing 20. The bridges 51, 61 of the resilient member 50 and the slide 60 surround the lock arm 28; and the holders 62 of the slide 60 are held substantially horizontal along the upper surfaces of the release guides 34. Additionally, the guides 64 contact the front ends of the guide grooves 47; and the downwardly sloped front portions 52*a* of the arms 52 of the resilient member 50 are located before the release guides 34. At this time, the bottom ends of the spring-pressing portions 53 are in the connection space S and can be pushed back by the front end surface 10*a* of the receptacle 10 of the male housing 10. The bottom ends of the spring-pressing portions 53 serve as pushable portions 56.

Figure 5:
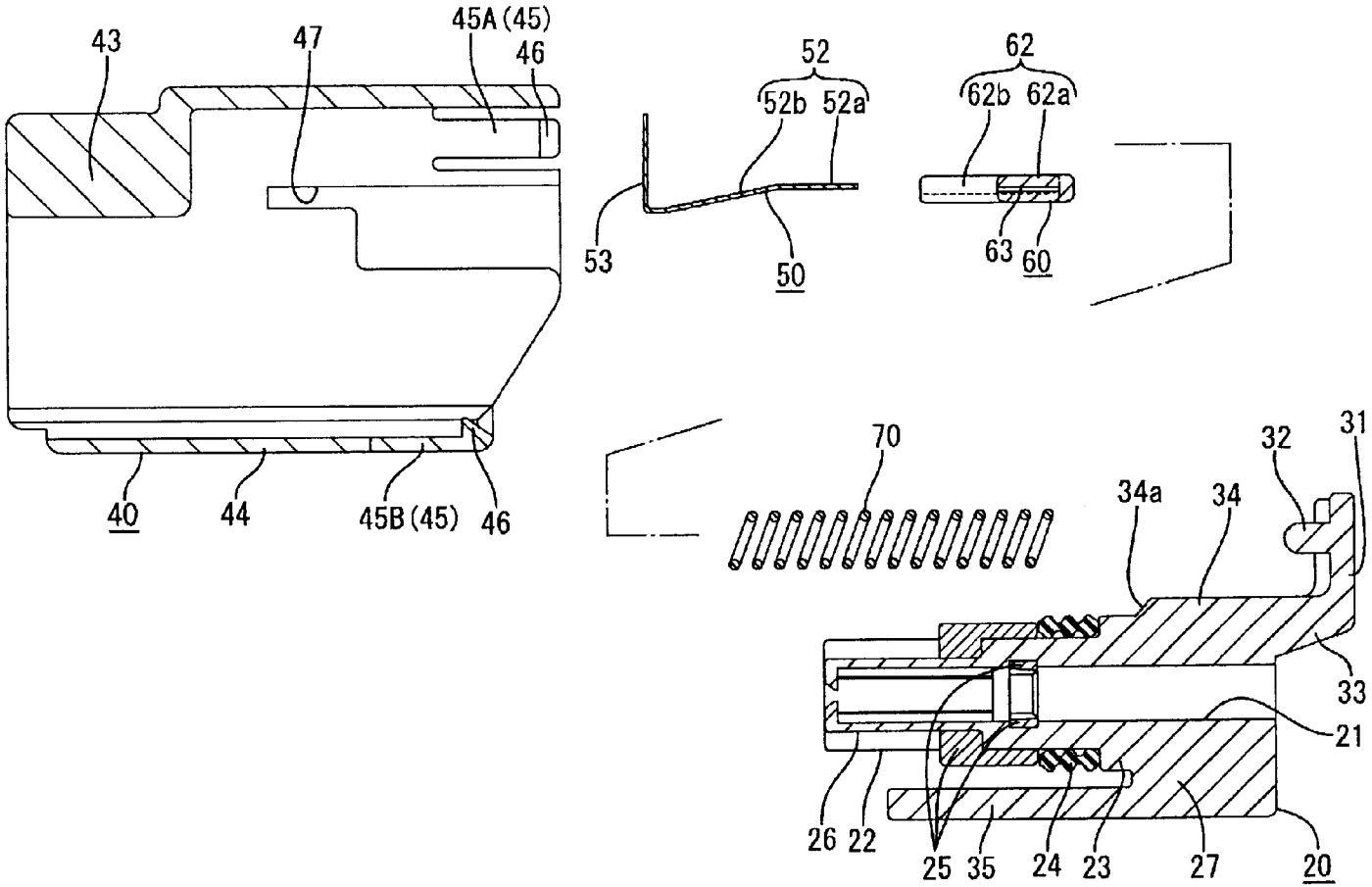
FIG. 5 is a section along 5—5 of FIG. 1.

The female connector 20 can be assembled by pressing the rear portions 52*a* of the arms 52 of the resilient member 50 into the holding grooves 63 of the slide 60 for holding the resilient member 50 and the slide 60 as an integral unit, as shown in FIGS. 4 and 5. This integral unit of the resilient member 50 and the slide 60 is inserted into the cover 40 from behind until the spring-pressing portions 53 contact the front-stops 43 and the guides 64 reach the front ends of the guide grooves 47. The springs 70 then are inserted so that the front ends of the springs 70 contact the spring-pressing portions 53.

The female housing 20 then is inserted into the cover 40 from behind and is moved forward until reaching the initial mount position while inserting the guide rail 35 into the guide channel 44. Then, as shown in FIG. 8, the claws 46 of the holding arms 45 engage the rear end surface of the female housing 20 to prevent the cover 40 from being displaced forward from the initial mount position on the female housing 20. In this process, the engaging projections 32 fit into the rear ends of the springs 70 and the spring-receiving portions 31 contact the rear ends of the springs 70. Thus, the springs 70 are held between the spring-receiving portions 31 and the spring-pressing portions 53 and are compressed slightly. Further, the holders 62 of the slide 60 move onto the release guides 34 of the rear step 27 to be held substantially vertically.

The connection space S is defined between the terminal-accommodating portion 22 and the cover 40, and the pushable portions 56 of the two spring-pressing portions 53 of the resilient member 50 are in the connection space S, as shown in FIG. 6. Further, the female terminal fitting, the retainer 25, the seal ring 24, etc. are mounted in the female housing 20. The respective parts may be assembled in an order and by a method other than the above. For example, the female housing 20 may be mounted into the cover 40 after the springs 70 may be mounted into the female housing 20.

Figure 9A:
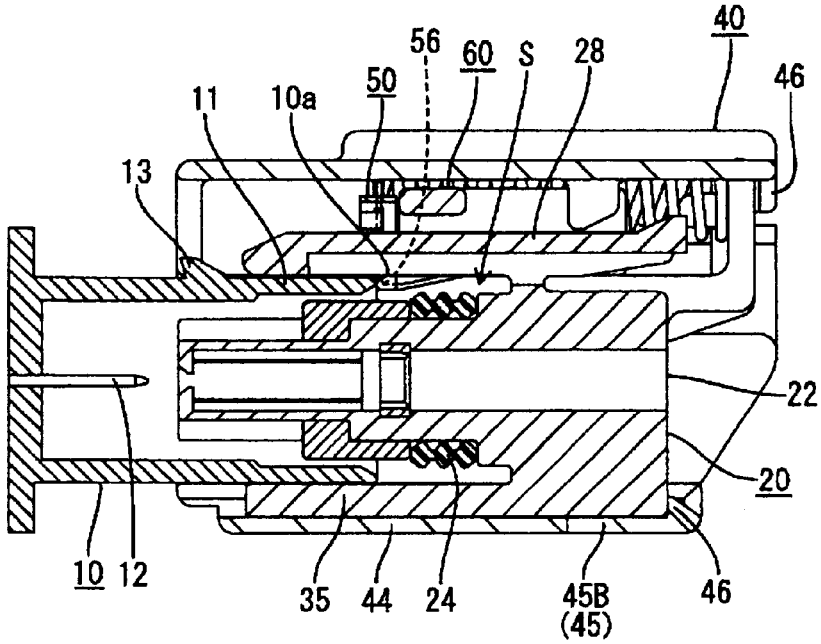
FIGS. 9(A) and 9(B) are sections similar to FIGS. 8(A) and 8(B), but showing a from end surface of a receptacle contacting pushable portions during the connection of the two housings.
Figure 9B:
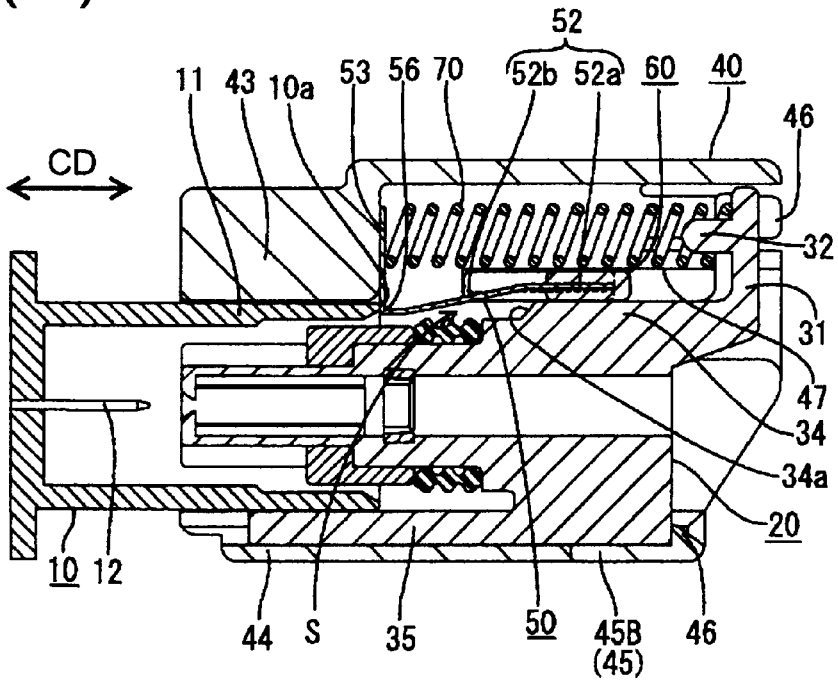

The receptacle 11 is aligned with the connection space S and the operable portions 41 of the cover 40 and/or the rear end surface of the female housing 20 are pushed forward to connect the housings 10, 20. At this time, the cover 40 is held at the initial mount position with respect to the female housing 20 by the holding arms 45A, 45B and will not move further forward by these pushing forces. Thus, the female housing 20 and the cover 40 are connected with the male housing 10. When the receptacle 11 reaches a specified depth in the insertion space S, the front end surface 10*a* contacts the pushable portions 56 of the resilient member 50 as shown in FIG. 9. As the connecting operation progresses in this state, the resilient member 50 and the slide 60 are pushed back by the front end surface 10*a* of the receptacle 11. At this stage, the springs 70 are compressed resiliently by the relative backward movements of the spring-pressing portions 53 that support the front ends of the springs 70 with respect to the spring-receiving portions 31 that support the rear ends of the springs 70, thereby accumulating biasing forces to separate the housings 10, 20 (see FIG. 10(B)). In this process, the lock arm 28 is displaced resiliently and moves onto the lock projection 13 (see FIG. 10(A)).

The connecting operation could be interrupted in the partly connected state of the two housings 10, 20. As a result, the biasing forces accumulated thus far in the resiliently compressed springs 70 are released, and the pushable portions 56 of the resilient member 50 push the front end surface 10*a* of the receptacle 11 back to separate the two housings 10, 20 forcibly. This prevents the housings 10, 20 from being left only partly connected.

Figure 10A:
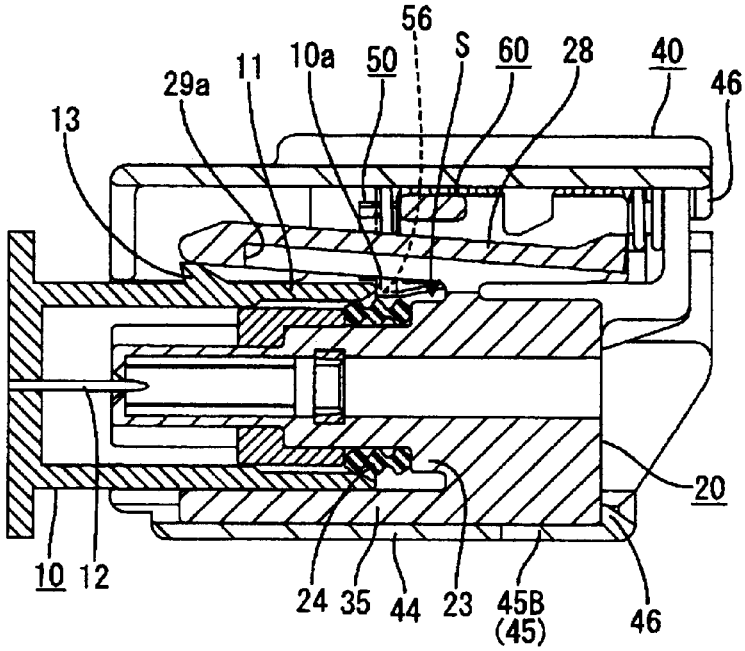
FIG. 10(A) is a section similar to FIG. 8(A), but showing a state where a lock arm is resiliently displaced during the connection of the two housings.
Figure 10B:
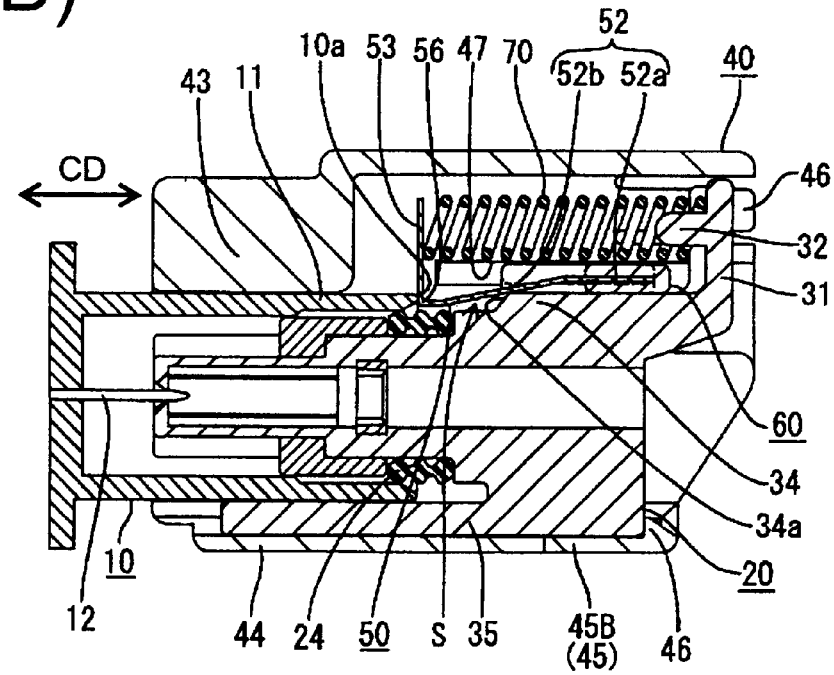
FIG. 10(B) is a section similar to FIG. 8(B), but showing a state where arms contact release guides during the connection of the two housings.

The resilient member 50 and the slide 60 move back as the connecting operation continues, and reach a depth where the sloped front portions 52*a* of the arms 52 contact the front ends 34*a* of the release guides 34, as shown in FIG. 10(B). Thus, the arms 52 move onto the release guides 34 and deform up in a deformation direction DD with the rear portions 52*a* of the arms 52 functioning as supports. More particularly, the front portions 52*a* of the arms 52, the spring-pressing portions 53, the pushable portions 56, and the bridge 51 are displaced up, thereby gradually reducing an engaged area of the pushable portions 56 with the front end surface 10*a* of the receptacle 11. The pushable portions 56 completely disengage from the front end surface 10*a* of the receptacle 11 immediately before the housings 10, 20 reach a proper connection. Consequently, the restriction on the forward movements of the resilient member 50 and the slide 60 is canceled, and, as shown by phantom in FIG. 11(B), the springs 70 expand to propel the resilient member 50 and the slide 60 forward.

Figure 11A:
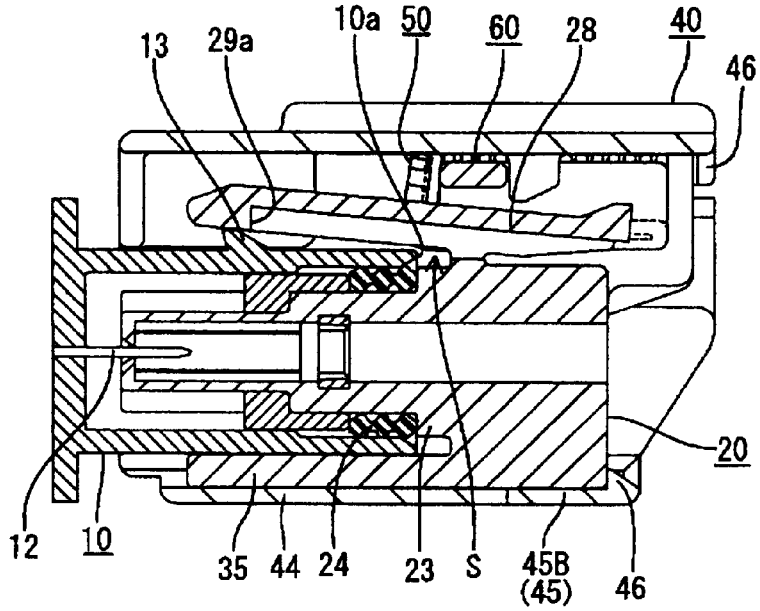
FIG. 11(A) is a section similar to FIG. 8(A), but showing the lock arm resiliently displaced immediately before the housings are connected properly.
Figure 11B:
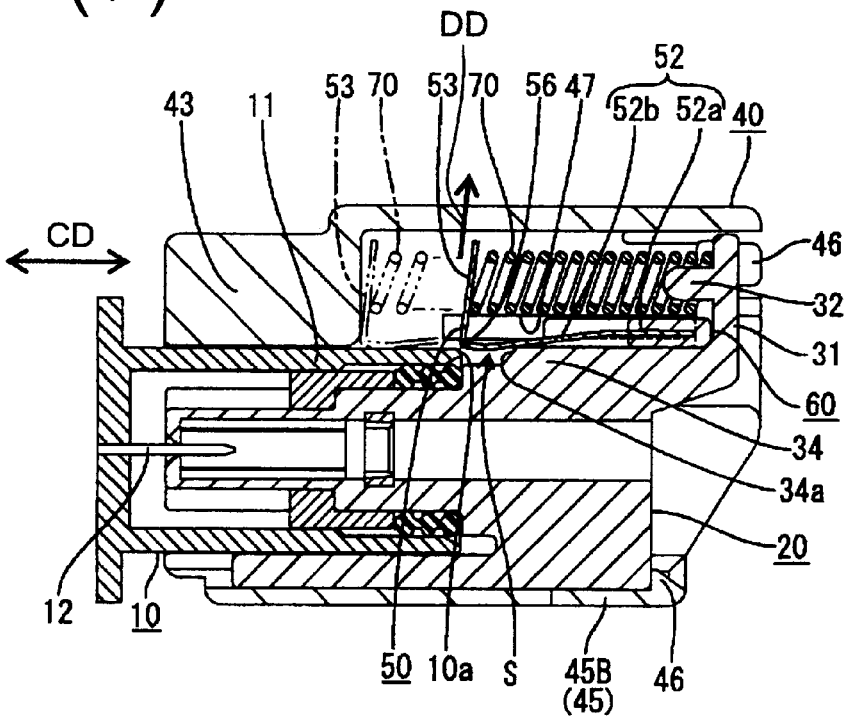
FIG. 11(B) is a section similar to FIG. 8(B) showing the pushable portions disengaged from the front end surface of the receptacle immediately before the housing are connected properly.

The housings 10, 20 can be connected automatically to a proper depth after reaching a connection depth immediately before the proper connection shown in FIGS. 11A and 11B. This final stage of connection is achieved by an inertial force that has been acting thus far and a forward-acting force given to the cover 40 by the contact of the forward-moving spring-pressing portions 53 of the resilient member 50 with the front-stops 43. Thus, as compared to a case where the springs are compressed until the housings are connected properly, a degree of compression of the springs 70 in the connecting process is smaller and the force necessary for the connecting can be reduced.

The lock arm 28 moves beyond the lock 13 and is restored resiliently when the housings 10, 20 are connected properly.

Figure 12A:
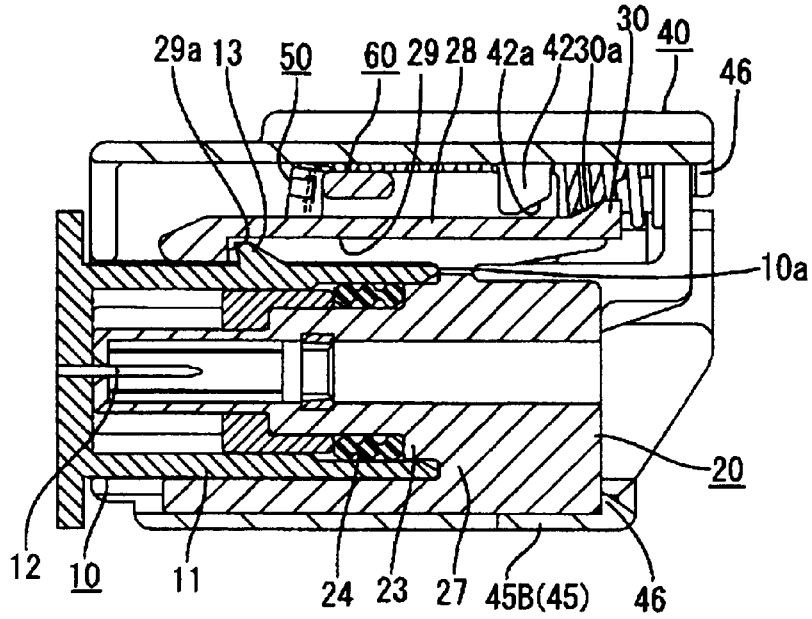
FIG. 12(A) is a section similar to FIG. 8(A), but showing the lock arm engaged with a lock when the housings are connected properly.
Figure 12B:
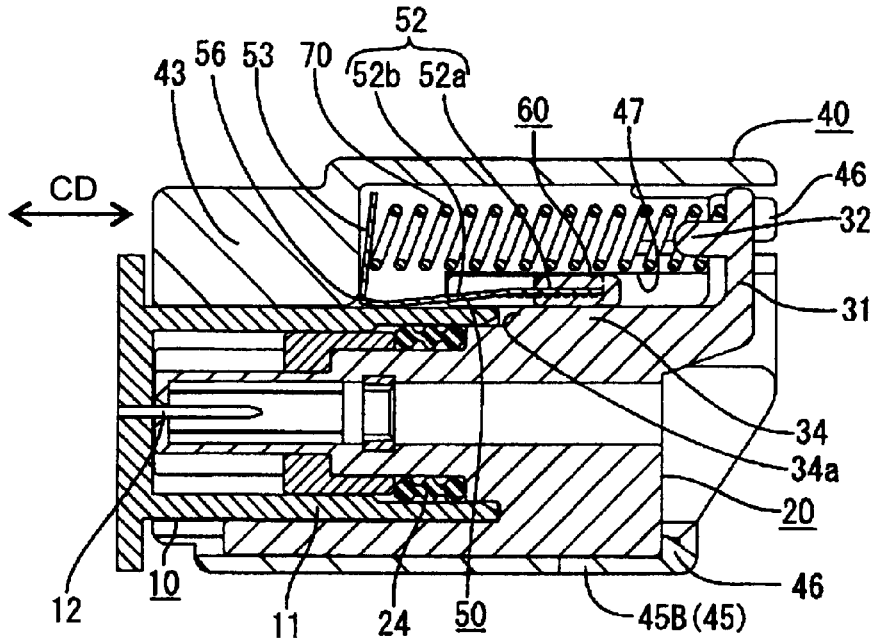
FIG. 12(B) is a section similar to FIG. 8(B), but showing the resilient member and the slide moved forward when housings are connected properly.
Figure 13A:
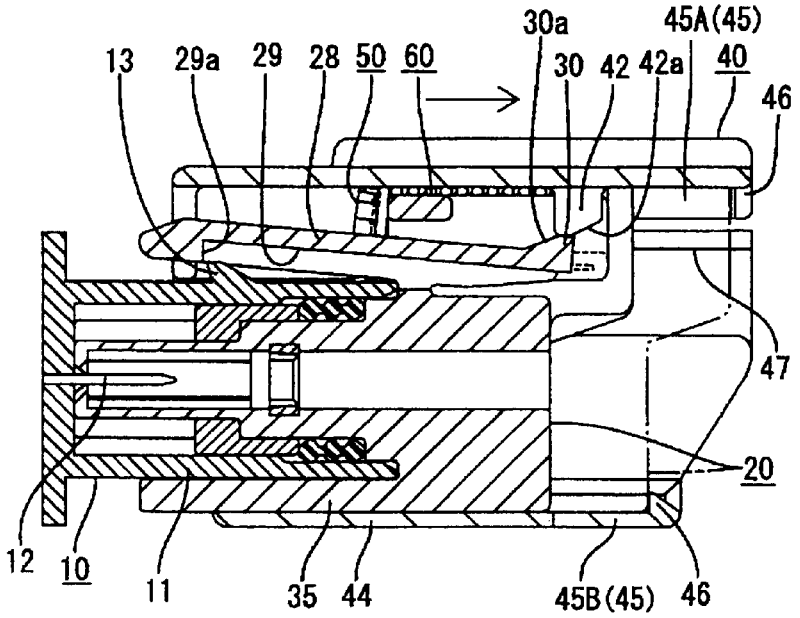
FIG. 13(A) is a section similar to FIG. 8(A), but showing the lock arm displaced during separation of the housings.
Figure 13B:
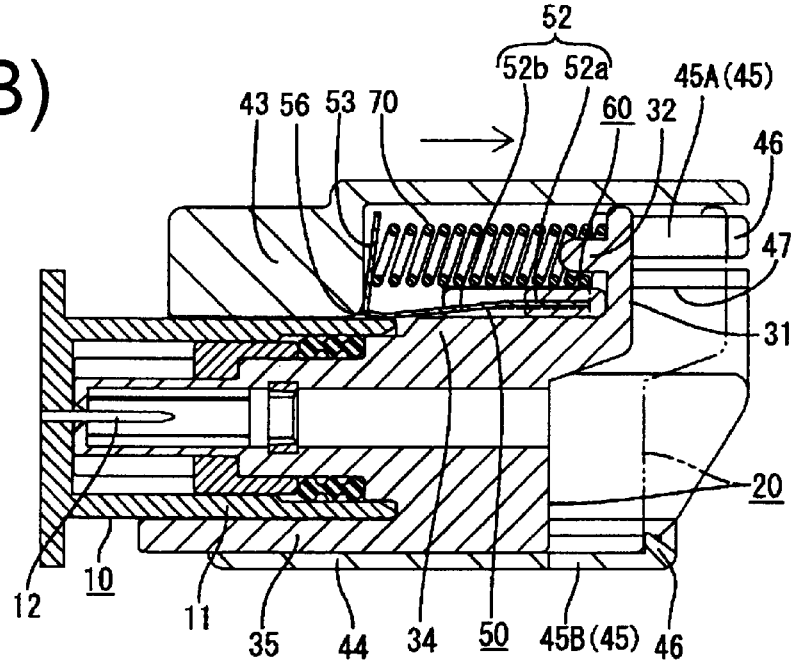
FIG. 13(B) is a section similar to FIG. 8(B), but showing the resilient member and the slide moved back together with the cover during the separation of the housings.
Figure 14A:
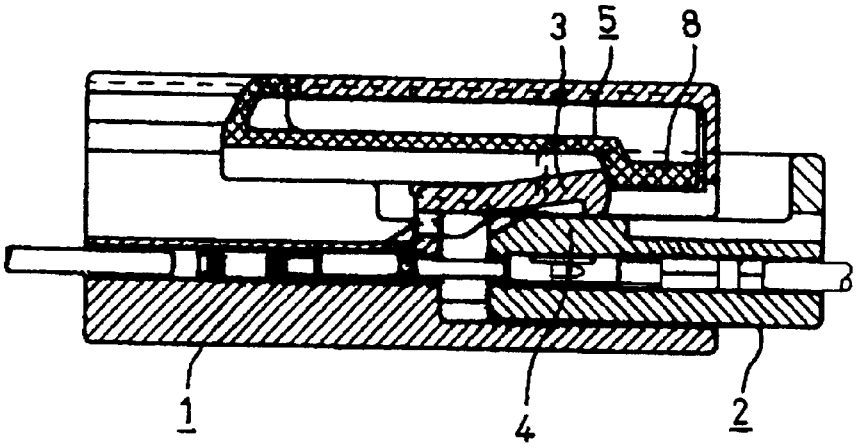
FIG. 14(A) PRIOR ART
FIG. 14(A) is a section along a lock arm showing a partly connected state of prior art connector.
Figure 14B:
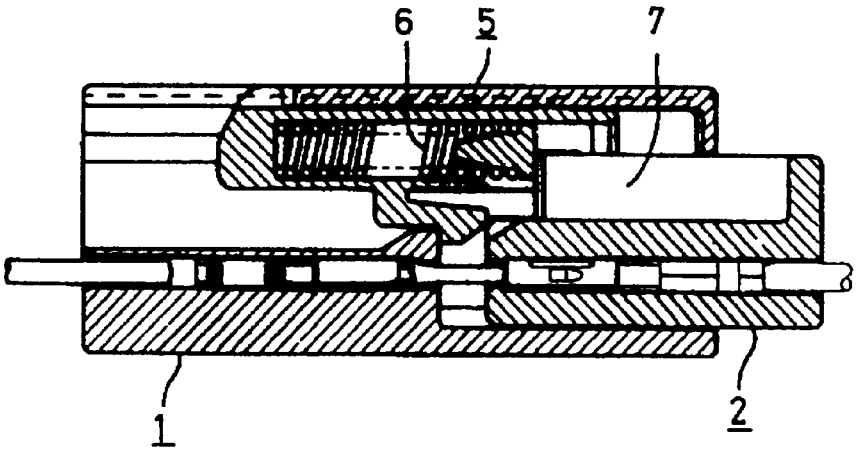
FIG. 14(B) PRIOR ART
FIG. 14(B) is a section along a spring showing the partly connected state of the prior art connector.
Figure 15A:
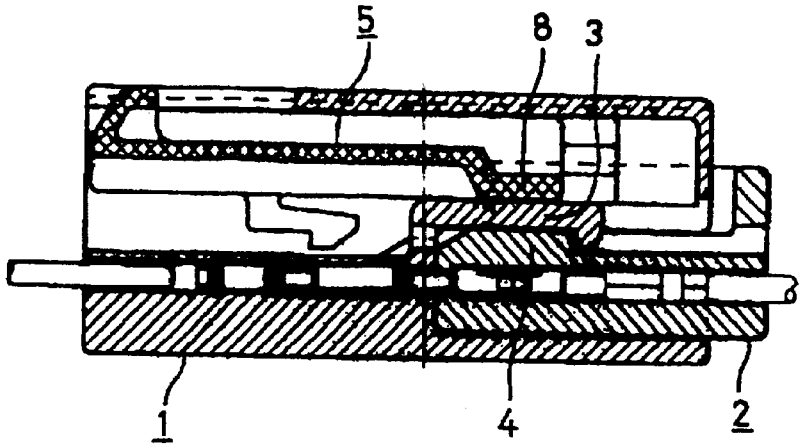
FIG. 15(A) PRIOR ART
FIG. 15(A) is a section along the lock arm showing a properly connected state of the prior art connector.
Figure 15B:
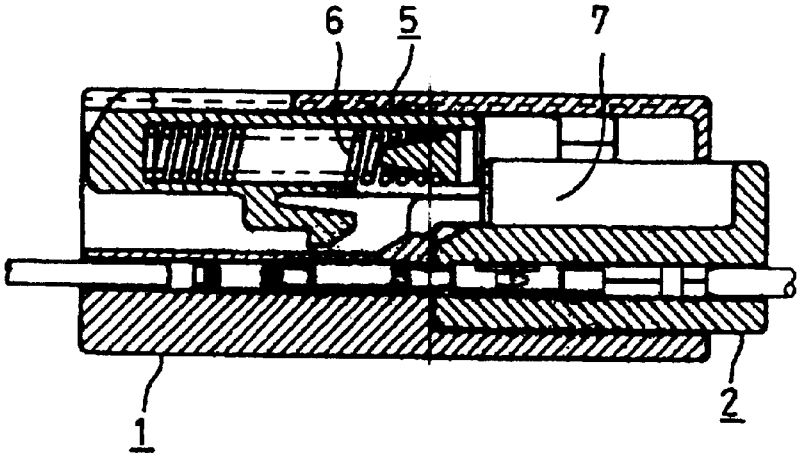
FIG. 15(B) PRIOR ART
FIG. 15(B) is a section along the spring showing the properly connected state of the prior art connector.

Thus, the front end surface 29*a* of the groove 29 engages the rear end surface of the lock 13, as shown in FIG. 12(A), to lock the housings 10, 20 together in the properly connected state. The arms 52 of the resilient member 50 remain in a resiliently deformed state and are supported on the upper surface of the receptacle 11, as shown in FIG. 12(B). Additionally, the spring-pressing portions 53 are held in contact with the front-stops 43 while leaning backward. At this time, the guide projections 64 of the slide 60 are in contact with the front ends of the guide grooves 47. Further, in this properly connected state, male and female terminal fittings are connected properly, and the seal ring 24 is held in close contact with the inner surface of the receptacle 11 and the outer surface of the terminal accommodating portion 22 to seal the space between the housings 10, 20.

The housings 10, 20 can be detached from each other by pulling the operable portions 41 of the cover 40 back relative to the locked female housing 20. At this time, the spring-pressing portions 53 contact the front-stops 43 of the cover 40 to prevent the resilient member 50 from moving further forward. Thus, the, front-stops 43 of the cover 40 push the spring-pressing portions 53 back as the cover 40 is moved back. Further, the guides 64 of the slide 60 are held in contact with the front ends of the guide grooves 47 of the cover 40, and hence the front ends of the guide grooves 47 push the slide 60 back as the cover 40 is moved back. Accordingly, the resilient member 50 and the slide 60 are moved back relative to the female housing 20 together with the cover 40, and resiliently compress the springs 70. The unlock pressing portions 42 of the cover 40 contact the slanted surfaces 30*a*of the unlock guides 30 of the lock arm 28 as the cover 40 is moved back and press the rear end of the lock arm 28 down. The seesaw action of the lock arm 28 shown in FIG. 13(A) automatically displaces the front end surface 29*a* of the groove 29 of the lock arm 28 up and away from the rear end surface of the lock 13, and enables the housings 10, 20 to be disengaged. The biasing forces accumulated in the springs 70 are released as the housings 10, 20 are disengaged. Thus, the female housing 20 is moved back relative to the cover 40, the resilient member 50, the slide 60 and the male housing 10, as shown by phantom in FIGS. 13(A) and 13(B). Accordingly, the lock, arm 28 is restored. At this time, the cover 40 is moved further back, taking advantage of a backward-acting force given to the cover 40 by the collision of the backwardly moving female housing 20 with the claws 46 of the holding arms 45, thereby pulling the female housing 20 from the male housing 10 at one stroke. In this way, the one operation of pulling the cover 40 back, also displaces the lock arm 28 to cancel the locked state and pulls the housings 10, 20 apart.

As described above, the operating direction of the cover 40 is the same as the separating direction of the female housing 20 when the housings 10, 20 are separated. Thus, operability during the separating operation is good. Further, the housings 10, 20 are connected and separated from by operating the cover 40. Thus, operability is better as compared to a connector in which the female housing is operated during the connecting operation and the cover is operated during the separating operation.

When the cover 40 is moved back to separate the housings 10, 20, the unlock pressing portions 42 push the unlock guides 30 to resiliently displace and disengage the lock arm 28 from the lock projection 13. Thus, the lock arm 28 can be displaced automatically by moving the cover 40 back, and operational efficiency to separate the housings 10, 20 is better than a connector that necessitates a separate operation of resiliently displacing the lock arm.

The construction of the male housing 10 is simplified since the pushable portions 56 of the resilient member 50 are pushed by the front end surface 10*a* of the male housing 10. If the pushable portions 56 of the resilient member 50 are pushed by the front end surface 10*a* of the male housing 10, the arms 52 of the resilient member 50 remain moved onto the receptacle 11 and resiliently displaced when the housings 10, 20 are connected properly. However, the resilient member 50 is metallic, and resiliency with time will not deteriorate as compared to a case where the resilient member is resin.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The compression coil springs are released immediately before the housings are connected properly in the foregoing embodiment. However, connectors., having a function of more securely preventing the partial connection of the housings by releasing the compression coil springs at the same time or after the two housings are properly connected also are embraced by the present invention.

In the foregoing embodiment, the unlock guides and the unlock pressing portions automatically displace the lock arm by moving the cover back during the separating operation. Instead, a guide surface may be provided, for example; at one of mutual engaged portions of the lock arm or at the lock projection, and the lock arm may be deformed automatically to cancel the locked state when an operation force of a specified magnitude or larger is given by the guide surface to separate the two housings. In such a case, the cover may have a deformation-preventing portion that can enter the deformation permitting space for the lock arm to stabilize the locked state. The cover also may be provided with a vertically resiliently deformable operable piece and pressing the operable piece may displace the lock arm. Further, the unlock guides may be deleted and the lock arm may be displaced by direct pressing.

The spring-pressing portions of the resilient member and/or the guides of the slide are prevented from further forward by the front-stops and the guide grooves of the cover in the foregoing embodiment. However, only one of the resilient member and the slide may be held at its front-limit position by the cover. Further, the slide may be deleted according to the present invention.

The cover that surrounds the female housing is the operable member in the foregoing embodiment. However, an operable member that does not surround the female housing also is embraced by the present invention.

The cover, the springs, and the resilient member are assembled with the female housing and the male housing pushes the resilient member in the foregoing embodiment. However, a reversed arrangement of the male and female housings is also is embraced by the invention.

The resilient member is metallic in the foregoing embodiment, but a nonmetallic resilient member may be employed.

Although the compression coil springs are shown as biasing members in the foregoing embodiment, leaf springs and the like may also be used.

Although a watertight seal ring is shown in the foregoing embodiment, the invention is also applicable to nonwatertight connectors.

What is claimed is:

1. A connector, comprising first and second housings (10, 20) connectable with each other and having locking means (28; 13) for locking the housings (10, 20) into a properly connected state (FIG. 13), the second housing (20) comprising:

a resilient member (50) mounted in the second housing (20) for movement substantially along a connecting direction (CD) of the housings (10, 20) and being configured for contact by a pushing portion (10*a*) on the first housing (10) in the process of connecting the housings (10, 20), such that the resilient member (50) is pushed back during connection of the housings (10, 20), the resilient member (50) being resiliently displaceable along a direction (DD) at an angle to the connecting direction (CD), a release guide (34) for guiding the resilient displacement of the resilient member (50) to release the resilient member (50) from a pushed state by the pushing portion (10*a*) substantially when the housings (10, 20) are connected properly with each other, and a biasing member (70) between the resilient member (50) and the second housing (20) and being resiliently deformable for accumulating a biasing force to separate the housings (10, 20) as the resilient member (50) is moved backward.

2. The connector of claim 1, further comprising an operable member (40) movable substantially along the connecting direction (CD), and being assembled with the second housing (20) to define a front-limit position thereof.

3. The connector of claim 2, wherein the operable member (40) supports the resilient member (50) to stop at the front-limit position thereof.

4. The connector of claim 1, wherein the locking means (28; 13) comprises a lock (13) on one (10) of housings (10, 20) and a resiliently deflectable lock arm (28) on the other (20) of the housings (10, 20) for engaging the lock (13) when the housings (20, 10) are connected properly.

5. The connector of claim 4, wherein at least one of the lock arm (28) and the operable member (13) comprises an unlocking means (30; 42) for resiliently displacing the lock arm (28) to disengage the lock arm (28) from the lock (13) as the operable member (50) is moved backward when the housings (10, 20) are to be separated from each other.

6. The connector of claim 5, wherein the unlocking means (30; 42) comprises an unlock pressing portion (42) for pressing the lock arm (28) out of engagement from the locking portion (13).

7. The connector of claim 6, wherein the unlocking means (30; 42) unlocks the housings (10, 20) at a position of the operable member (40) more backward than the front-stop position.

8. The connector of claim 6, wherein the resilient member (50) is metallic.

9. The connector of claim 6, wherein the pushing portion is formed by the front end surface of the second housing.

10. A connector, comprising:

a first housing (10) having a front end (10*a*) and a lock (13);

a second housing (20) having a terminal accommodating portion (22) with a front end configured for connecting with the front end (10*a*) of the first housing (10), a release guide (34*a*) and a pivot support projecting outwardly on the terminal accommodating portion (22), a lock arm (28) extending forwardly and rearwardly from the pivot support and being pivotable about the pivot support, a locking means (29*a*) on the lock arm forward of the pivot support for engaging the lock (13) when the housings (10; 20) are connected properly, and an unlock guide (30) on the lock arm (28) rearward of the pivot support;

a resilient member (50, 60, 70) mounted to the second housing (20) for movement substantially along a connecting direction (CD) of the housings (10, 20) and being biased toward the front end of the second housing (20), a portion of said resilient member (60) being engaged by the front end (10*a*) of the first housing (10) before the housings (10; 20) are connected properly for resisting the bias of the resilient member (50, 60), a portion of the resilient member (50) being resiliently displaceable away from the front end (10*a*) of the first housing (10) in response to engagement with the release guide (34) when the housings (10, 20) are connected substantially properly with each other; and an operable member (40) mounted on the second housing (20) for movement away from the front end of the terminal accommodating portion (22) and being engageable with the unlock guide (30) for pivoting the lock arm (28) away from the lock (13) of the first housing (10).

11. The connector of claim 10, wherein the resilient member (50, 60, 70) comprises a metallic member (50) configured for engagement by the front end (10*a*) of the first housing (10) before the housings (10; 20) are connected properly, and configured for deflecting away from the front end (10*a*) of the first housing (10) when the housings (10; 20) are connected properly.

12. The connector of claim 11, wherein the resilient member (50; 60; 70) further comprises at least one spring (70) for biasing the resilient member (50; 60) forward.

* * * * *